United States Patent [19]

Funabashi et al.

[11] Patent Number: 4,505,851

[45] Date of Patent: Mar. 19, 1985

[54] PROCESS FOR SOLIDIFYING RADIOACTIVE WASTE PELLETS

[75] Inventors: Kiyomi Funabashi, Katsuta; Fumio Kawamura; Makoto Kikuchi, both of Hitachi; Hideo Yusa, Katsuta, all of Japan

[73] Assignee: Hitachi, Ltd., Tokyo, Japan

[21] Appl. No.: 381,293

[22] Filed: May 24, 1982

[30] Foreign Application Priority Data

May 29, 1981 [JP] Japan ..... 56-80972

[51] Int. Cl.[3] ..... G21F 9/16

[52] U.S. Cl. ..... 252/628; 252/629

[58] Field of Search ..... 252/628, 629

[56] References Cited

U.S. PATENT DOCUMENTS 3,837,872 9/1974 Conner ..... 106/74
3,988,258 10/1976 Curtiss et al. ..... 252/628
4,018,616 4/1977 Sugahara et al. ..... 106/74
4,173,546 11/1979 Hayes ..... 252/628

FOREIGN PATENT DOCUMENTS 52-076600 6/1977 Japan ..... 252/628

*Primary Examiner*—Deborah L. Kyle
*Attorney, Agent, or Firm*—Beall Law Offices

[57] ABSTRACT

In storing of radioactive wastes by drying, pulverization and pelletizing, radioactive waste pellets are solidified with an alkali silicate solution as a filler, a substance having an action to harden the alkali silicate solution, and a substance having an action to absorb the water formed by the hardening reaction of the alkali silicate solution, or a substance having both actions to harden the alkali silicate solution and to absorb the water formed by the hardening reaction. The solidification can be attained with easy operation and prolonged stability at a low cost.

52 Claims, 2 Drawing Figures

PROCESS FOR SOLIDIFYING RADIOACTIVE WASTE PELLETS

BACKGROUND OF THE INVENTION

This invention relates to a process for solidifying radioactive waste pellets.

Reduction of volume and solidification into drums of radioactive wastes generated in an atomic power plant are not only important for maximum utilization of a storage space in the plant site, but also indispensable for on-land storage as one of the ultimate disposals.

A process for reducing the volume of radioactive wastes by drying and pulverizing concentrated liquid waste containing $Na_2SO_4$ as the major component and a slurry of ion exchange resin powder, major wastes generated in a BWR plant, thereby removing the water that takes the most portion of the volume of radioactive waste, and pelletizing the resulting powder has been so far investigated, and it has been confirmed that the volume can be reduced thereby to about one-eighth of the volume obtained according to the conventional process of direct solidification of the liquid waste and the slurry by cement. However, the said process has a good effect upon the reduction of volume, but still has such a disadvantage that a stable solidification product cannot be obtained by a hydraulic setting filler such as cement, etc., because cement is used, as mixed with water, and the water is reabsorbed into the dried powder to increase the volume of dried powder and break the pellets. To this end, a process for solidification by a filler requiring no water, for example, asphalt, plastics, etc. has been investigated. However, the process still has such disadvantages that operation must be carried out at a high temperature and the fillers themselves are expensive.

Thus, a process for solidification of radioactive waste pellets by a solidifying agent with easy operation and prolonged stability at a low cost has been desired.

SUMMARY OF THE INVENTION

An object of the invention is to provide a process for solidifying radioactive waste pellets with easy operation and prolonged stability at a low cost.

The present invention is characterized by solidifying radioactive waste pellets with an alkali silicate solution as a filler, a substance having an action to harden the alkali silicate solution (the substance will be hereinafter referred to as "a hardening agent"), and a substance having an action to absorb the water formed by hardening reaction of the alkali silicate solution (the substance will be hereinafter referred to as "water absorbent"), or a substance having both actions to harden the solution and absorb the water formed by the hardening reaction.

DETAILED DESCRIPTION OF THE PREFERRED EMBODIMENTS

Figure 1:
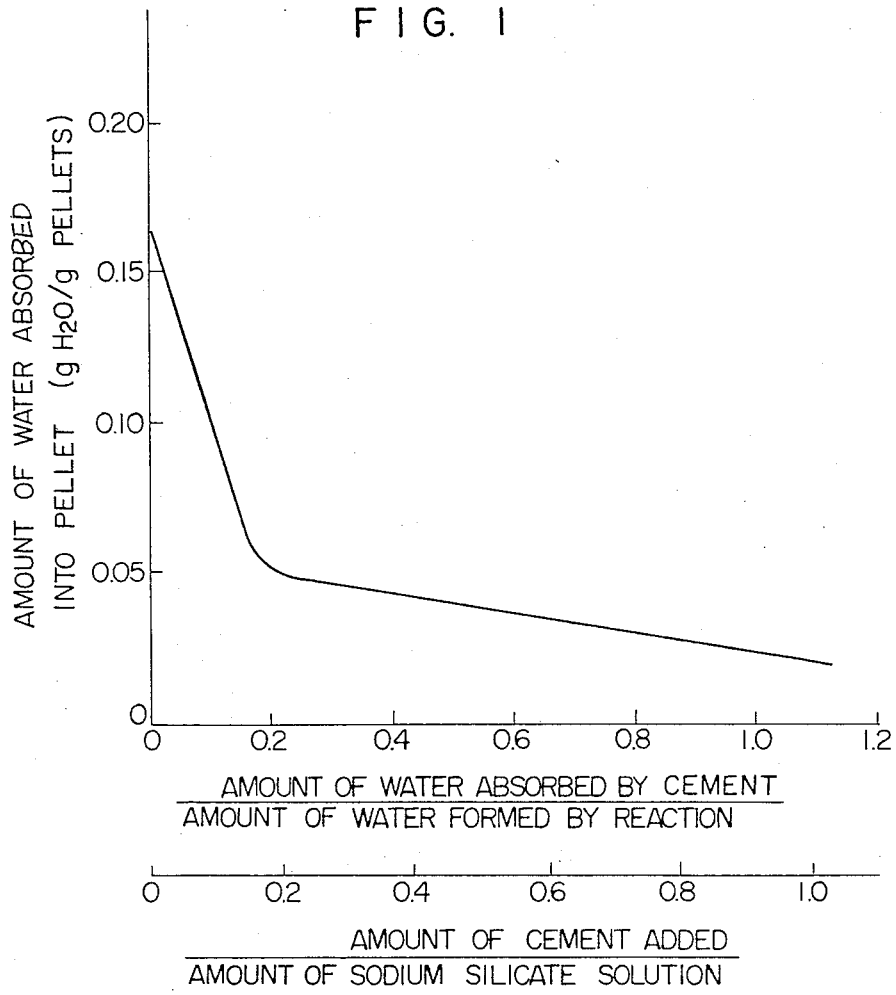
FIG. 1 shows relations between pellet water absorption and amount of water absorbent added.

The present invention is based on the results of tests and analysis given below.

The alkali silicate solution has been so far well known as "water glass". The present inventors have found that immersion of radioactive waste pellets in the alkali silicate solution does not give rise to water absorption into the pellets. It seems that the water in the alkali silicate solution is not the so-called free water, but bound water such as water of crystallization or water of hydration, where the alkali silicate solution is represented by the chemical formula, $M_2O.nSiO_2.xH_2O$, where M stands for an alkali metal.

Cement has been so far used as a filler. Cement is used, as mixed with water, and the water exists in a free state in the initial period of mixing. 3 or 4 days after the mixing, the water in the cement turns into bound water. Thus, the present inventors have conceived that the solidification of radioactive waste pellets should be made by an alkali silicate solution rather than by cement. However, in the case of an alkali silicate solution, free water is formed from the bound water according to the following hardening reaction:

$$M_2O.nSiO_2.xH_2O+MPO_3 \rightarrow nSiO_2+xH_2O+M_3PO_4$$

In the foregoing formula, $MPO_3$ powder is used as a hardening agent, and free water is likewise formed by other hardening agents.

As is obvious from the foregoing, water absorption into pellets can be prevented by an alkali silicate solution as such, but the water formed at hardening turns into free water and absorbed into pellets, with the failure of stable solidification of pellets.

Thus, the present inventors have conceived that, by adding a water absorbent to an alkali silicate solution when mixed with a hardening agent, the free water formed by the hardening reaction of the alkali silicate solution is absorbed into the water absorbent as bound water, etc. The present inventors have made extensive studies of various water absorbents and have succeeded in producing a good solidified product of radioactive waste pellets.

Conditions for producing a good solidified product of radioactive waste pellets will be described below, referring to amounts of water in a sodium silicate solution, species of hardening agents, and species and amounts of water absorbent.

The radioactive waste pellets for use in tests of determining the conditions are the pellets prepared by drying and pulverizing an artificial concentrate liquid, the major component of the pellets being $Na_2SO_4$ powder.

The amount of water in a sodium silicate solution: the amount of unbound water, i.e. free water, increases with increasing amount of water. Test results with the said pellets show that, when the amount of water in a sodium silicate solution, as represented by $Na_2O.nSiO_2.xH_2O$, is not more than 80% by weight, water absorption into pellets can be prevented. When the amount of water is decreased, the viscosity of a sodium silicate solution is increased, and the flowability of the solution is lost, with the failure of solidification. The amount of water in that case, that is, the lower limit amount of water, is about 40% by weight.

With the sodium silicate solution containing 60% by weight of water which is within the foregoing range, various hardening agents were tested. The results are shown in Table 1.

TABLE 1

| Hardening agent | | Homogeneity |
|---|---|---|
| Phosphates | $NaPO_3$ (powder) | good |
| | $Na_2HPO_4$ (powder) | good |

TABLE 1-continued

| Hardening agent | | Homogeneity |
|---|---|---|
| | $Mo_{m/2}.nP_2O_5$ (powder) | better |
| Strong acids | $H_2SO_4$ (Aq. Soln) | poor |
| | HCl (Aq. Soln) | poor |
| | $HNO_3$ (Aq. Soln) | poor |

In the tests, homogeneity after hardening was investigated for phosphates and strong acids, and it was found that the phosphates were better, and, above all, an inorganic phosphate compound powder represented by $Mo_{m/2}.nP_2O_5$ is particularly better. The inorganic phosphate compound powder is disclosed in Japanese Patent Publication No. 24206/78. According to the said Japanese Patent Publication, uneven hardening due to partial rapid hardening of a sodium silicate solution can be prevented by a hardening agent capable of slowly releasing phosphoric acid, and even hardening can be obtained. The inorganic phosphate compound has a composition represented by the following formula:

$$MO_{m/2}.nP_2O_5$$

wherein M represents a metal including silicon, m the valency of the metal M, and n the number of 0.1 to 0.7, and also has an initial amount of elution (B) being not more than 250, and an average hydrolysis rate constant (A) being not less than 0.2, as defined by the following equation:

$$Y=AX+B$$

wherein X represents a duration in minutes from the time of preparing a sample solution by adding one gram of the said phosphate compound to 100 ml of 4N sodium hydroxide solution over to 120 minutes, and Y represents an integrated amount of phosphate eluted as $P_2O_5$ into the sample solution in mg/100 ml.

With the sodium silicate solution containing 55% by weight of water, various water absorbents were tested. Results are shown in Table 2.

TABLE 2

| Water absorbent | | Water absorption ($gH_2O$/g water absorbent) | Water absorption into pellets at solidification |
|---|---|---|---|
| Physical absorption | Silica gel | 0.9 | intermediate |
| | Alumina | 0.5 | intermediate |
| Chemical absorption | Cement (portland cement) | 0.6 | small |
| | Semi-hydrated gypsum ($CaSO_4.0.5H_5O$) | 0.2 | small |
| No water absorbent | | — | large |

The water absorbents were selected from those physically absorbing water and those chemically absorbing water as bound water. Their effects were determined on the basis of water absorption into pellets at solidification. It was found that the water absorption into pellets was decreased by addition of water absorbents and the conditions for forming a good solidified product could be satisfied thereby. It was further found that the water absorbents of chemical absorption had less water absorption into pellets than those of physical absorption and were effective for forming solidified products as aimed at in the present invention. It seems that differences in water absorption into pellets between those of physical absorption and those of chemical absorption depend upon the differences in their water-binding abilities.

To determine appropriate conditions of adding a water absorbent for obtaining a good solidified product of radioactive waste pellets, the amount of cement, i.e. the one having a good result among the water absorbents, was changed when added to a sodium silicate solution, and water absorption into pellets was measured. The results are shown in FIG. 1, where the amount of cement added to the sodium silicate solution and the corresponding absorption by cement of water, i.e. water formed by reaction of sodium silicate solution, are given on the abscissa as an index showing how much the water absorbent should absorb the water formed by the hardening reaction of a sodium silicate solution, and the amount of water absorbed into pellets (g $H_2O$/g pellets) are given on the ordinate. From FIG. 1, it is obvious that the water absorption into pellets tends to decrease with increasing amount of cement. When the water absorption into pellets is not more than 0.05 g $H_2O$/g pellets, that is, when the ratio of the amount of water absorbed by cement to the amount of the water formed by the reaction is not less than 0.2, the solidified product of pellets can be prevented from crack generation. An increased amount of cement added lowers the water absorption into pellets, whereas it increases the viscosity of a sodium silicate solution. It seems that this phenomenon is identical with the one as observed at the mixing of the ordinary powder with water. In view of such increase in viscosity, it is necessary to keep the ratio of the amount of water absorbed by cement to the amount of water formed by reaction not more than 1.0 to give a good flowability to the sodium silicate solution to produce a good solidified product of pellets. When the ratio exceeds 1.0, there remains unhydrated water absorbent, that is, unhydrated cement, and thus the resulting solidified product has a possibility to absorb water and swell, resulting in poor water resistance of the solidified product.

The foregoing description has been made of portland cement as the water absorbent. Self-setting cement, latent hydraulic setting cement, and mixed cement, as disclosed in "Kagaku Benran (Chemical Handbook), Oyō.hen (Volume Application)" published by Maruzen Co., June, 1981, pages 393–394, have the equal effect as the water absorbent. Furthermore, other water absorbents, which will be described later, have also the same effect, and a good solidified product of pellets can be produced when the ratio of the amount of the water absorbed by a water absorbent to the amount of the water formed by the reaction is in a range of 0.2 to 1.0.

Figure 2:
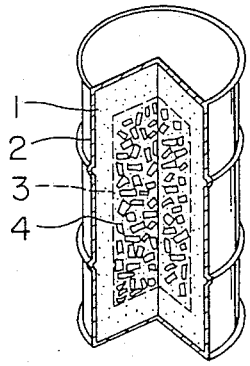
FIG. 2 is a partial cross-sectional view of a solidified product prepared according to the present invention.

One example of solidifying pellets in a drum of 200-l capacity as usually used for solidification of a radioactive waste will be given below on the basis of the foregoing results, referring to FIG. 2.

About 250 kg of radioactive waste pellets 4 containing $Na_2SO_4$ as the major component are filled into a wire-mesh cage 3 provided at a predetermined distance in a drum 2 of 200-l capacity. Then, a mixture of a sodium silicate solution, a hardening agent and a water absorbent is poured into the drum. The sodium silicate solution has a composition of 18% by weight of $Na_2O$, 27% by weight of $SiO_2$ and 55% by weight of $H_2O$, the hardening agent is an inorganic phosphate compound of slow phosphoric acid release type, represented by $SiO_2.nP_2O_5$, and the water absorbent is portland cement. The mixing ratio by weight of sodium silicate solution:-hardening agent:water absorbent is 1:0.4:0.2.

The clearances between the radioactive waste pellets are filled with the said mixture, and then gas bubbles remaining in the mixture are removed by vacuum degassing. Then, the filled drum is left standing at room temperature for hardening, which is completed in about 2 hours. Then, a hardened sodium silicate product 1 is formed. In this manner, a solidified product having a weight of about 440 kg as shown in FIG. 2 can be obtained. The solidified product has no crack generation due to water absorption into pellets and the resulting swelling, and also has a high strength.

In the present example, such a cheap material as sodium silicate solution can be used by addition of a water absorbent, and a solidified product of radioactive waste pellets having a high strength can be obtained.

In the foregoing example, the radioactive waste pellets are filled in the drum in advance, but a mixture of the radioactive waste pellets, the sodium silicate solution, the hardening agent, and the water absorbent can be poured into the drum with an equal effect.

In the foregoing example, a hardening agent and a water absorbent are used, but a single substance having both actions of hardening and water absorption, or a single substance having both actions together with a hardening and/or a water absorbent can be used. The single substance having both actions of hardening and water absorption includes a substance, one part of which acts as a water absorbent and other part of which acts as a hardening agent, a substance capable of reacting with $Na_2O$ in the sodium silicate solution to give a water absorption, a substance having a water-absorbing part and a hardening part, etc. Examples of these substances will be given below:

The substance, one part of which acts as a water absorbent and other part of which acts as a hardening agent, includes gypsum ($CaSO_4.\frac{1}{2}H_2O$), calcium chloride ($CaCl_2$), etc.

In the case of calcium salts, $Ca^{2+}$ reacts with a sodium silicate solution as follows, and undergoes hardening:

$$Na_2O.nSiO_2.xH_2O+Ca^{2+}\rightarrow CaO.nSiO_2\downarrow+xH_2O+2Na^+$$

On the other hand, the water absorption reaction proceeds as follows:

For gypsum:

$$CaSO_4\tfrac{1}{2}H_2O+3/2H_2O\rightarrow CaSO_4.2H_2O$$

For calcium chloride:

$$CaCl+6H_2O\rightarrow CaCl.6H_2O$$

The substance capable of reacting with $Na_2O$ in the sodium silicate solution to give water absorption includes boron oxide ($B_2O_3$), phosphorus pentoxide ($P_2O_5$), etc. Reactions of these substances with $Na_2O$, that is, the hardening reactions, proceed as follows:

$$Na_2O.nSiO_2.xH_2O+2B_2O_3\rightarrow nSiO_2+xH_2O+Na_2B_4O_7$$

$$3Na_2O.nSiO_2.xH_2O+P_2O_5\rightarrow nSiO_2+xH_2O+2Na_3PO_4$$

Water absorption reactions proceed as follows:

$$Na_2B_4O_7+10H_2O\rightarrow Na_2B_4O_7.10H_2O$$

$$Na_3PO_4+12H_2O\rightarrow Na_3PO_4.12H_2O$$

The substance having a water-absorbing part and a hardening part includes zeolite as crystalline aliminosilicate. The zeolite is represented by $M'_x[(AlO_2)_y(SiO_2)_z]mH_2O$, where M' stands for an alkali metal, hydrogen ions, etc. The zeolite, whose M' is hydrogen ion and whose $mH_2O$ is removed by heating, has both actions of hardening and water absorption. That is, the hardening reaction proceeds as follows:

$$Na_2O.nSiO.xH_2O+2/X.H_x[(AlO_2)_y(SiO_2)_z]\rightarrow nSiO_2+(x+1)H_2O+2/XNa_x[(AlO_2)_y(SiO_2)_z]$$

The water absorption reaction proceeds as follows:

$$Na_x[(AlO_2)_y(SiO_2)_z]+mH_2O\rightarrow Na_x[(AlO_2)_y(SiO_2)_z]mH_2O$$

Among these compounds, calcium salts, inorganic boron compounds such as boron chloride, etc. and inorganic phosphate compounds such as phosphorus pentoxide, etc. excluding the zeolite have a high hardening speed, so that the hardening takes place unevenly. In view of these phenomena, it is desirable that these compounds should be of slow release type as represented by $MO_{m/2}.nP_2O_5$ as described before. By using compounds of such type, two different operations of each mixing a hardening agent and a water absorbent can be reduced to a single operation. It has been found that the hardening of these gypsums in the sodium silicate solution takes place for about 5 minutes for hydrated gypsum, for about 30 minutes for semi-hydrated gypsum, and for at least 60 minutes for anhydrous gypsum. It is seen from these results that $Ca^{2+}$ ions elute from the hydrated gypsum into the sodium silicate solution, and the hardening takes place according to the following formula:

$$Na_2O.nSiO_2.xH_2O+CaSO_4.2H_2O\rightarrow CaO.nSiO_2.xH_2O+Na_2SO_4+2H_2O$$

where $CaO.nSiO_2.xH_2O$ is an insoluble hardened product. However, the hydrated gypsum has no water absorbability, and thus the semi-hydrated gypsum and the anhydrous gypsum are used in the present invention. By using these gypsums, two different operations of each mixing a hardening agent and a water absorbent can be reduced to a single operation.

The alkali silicate solution is not limited to the said water soluble sodium silicate solution, but can include a solution of other alkali salts such as potassium silicate or of water-dispersible siliceous materials.

To improve the property of the alkali silicate solution, the well known additives, for example, various metal oxides or hydroxides such as boron oxide, calcium oxide, magnesium oxide, zinc oxide, aluminum oxide, magnesium hydroxide, calcium hydroxide, aluminum hydroxide, etc.; various metal silicates such as calcium silicate, magnesium silicate, zinc silicate, aluminum silicate, etc.; various fluorosilicates such as aluminum fluorosilicate, calcium fluorosilicate, etc. can be added to the alkali silicate solution in any amount, generally, for example, in an amount of up to 100% by weight on the basis of $SiO_2$of the alkali silicate solution.

In the foregoing example, no reinforcing agent, etc. are added to the alkali silicate solution, but various reinforcing agents or fillers can be added thereto to increase the strength or to prevent the hardening shrinkage. For example, fibrous reinforcing agent such as staples, slivers, mats, fabrics, non-woven fabrics, nets, etc. of glass fibers, rock wool, slag wool, asbestos, carbon fibers, metallic fibers, etc. can be used as the reinforcing agent. Various inorganic fillers such as kaolin, fired clay, acid clay, activated clay, titanium dioxide, zirconium dioxide, alumina powder, barium sulfate, magnesium carbonate, calcium carbonate, zinc oxide, anhydrous gypsum, sand, etc. can be used as the filler.

In the foregoing example, the radioactive waste pellets containing $Na_2SO_4$ as the major component is used, and it has been confirmed that the similar effect can be obtained in the case of other pellets of waste ion exchange resin, etc.

According to the present invention, solidified products of radioactive waste pellets with a good weathering resistance can be produced at a low cost with an alkali silicate solution so far widely used.

What is claimed is:

1. A process for solidifying radioactive waste pellets comprising:

providing a container;

adding radioactive waste pellets to the container;

adding a liquid alkali silicate solution containing 40 to 80% by weight of water to the container;

adding a hardening agent to react with the alkali silicate solution to solidify the silicate and produce water; and adding a water absorbent to absorb the produced water, wherein the ratio of the amount of water absorbed to the amount of water formed is in the range of 0.2 to 1 thus producing a solid material having the radioactive pellets embedded therein.

2. The process according to claim 1, wherein the hardening agent is an inorganic phosphate compound having a composition represented by the following formula:

$$MO_{n/2}.nP_2O_5$$

wherein M represents a metal including silicon, m represents the valency of metal M, and n represents the number of 0.1 to 0.7, and having an initial amount of elution B being not more than 250, and an average hydrolysis rate constant A being at least 0.2, as defined by the following equation:

$$Y=AX+B$$

wherein X represents a duration in minutes from the time of preparing a sample solution by adding one gram of the inorganic phosphate compound to 100 ml of 4N sodium hydroxide solution up to 120 minutes, and Y represents an integrated amount of phosphate as $P_2O_5$ eluted into the sample solution in mg/100 ml.

3. A process according to claim 1, wherein the pellets, the alkali silicate solution, the hardening agent and the water absorbent are mixed together before they are added to the container.

4. A process according to claim 1, wherein the alkali silicate solution contains 60% water.

5. A process according to claim 1, wherein the water absorbent is capable of absorbing water as bound water.

6. A process according to claim 1, wherein the water absorbent is selected from the group consisting of cement, semi-hydrated gypsum and anhydrous gypsum.

7. A process according to claim 1, wherein the sodium silicate solution, the hardening agent and the water absorbent are added in a ratio of 1:0.4:0.2 respectively.

8. A process according to claim 1, wherein the alkali silicate solution is selected from the group consisting of sodium silicate solution and potassium silicate solution.

9. A process according to claim 1, wherein the alkali silicate solution comprises at least one of the following: metal oxide, metal hydroxide, metal silicate, and fluorosilicate.

10. A process according to claim 1, wherein the alkali silicate solution further includes a reinforcing agent.

11. A process according to claim 1, wherein the alkali silicate solution further includes a filler selected from the group consisting of kaolin, fired clay, acid clay, activated clay, titanium dioxide, zirconium dioxide, alumina powder, barium sulfate, magnesium carbonate, calcium carbonate, zinc oxide, anhydrous gypsum and sand.

12. A process for solidifying radioactive waste pellets comprising:

providing a container;

adding radioactive waste pellets to the container;

adding a liquid alkali silicate solution containing 40–80% by weight of water to the container; and adding a single substance which acts as a hardening agent reacting with the alkali silicate solution to solidify the silicate and produce water and which also acts as a water absorbent absorbing the produced water, wherein the ratio of the amount of water absorbed to the amount of water formed is in the range of 0.2 to 1;

thus producing a solid material having the radioactive waste pellets embedded therein.

13. The process according to claim 12, wherein the inorganic phosphate compound has a composition represented by the following formula:

$$MO_{n/2}.nP_2O_5$$

wherein M represents a metal including silicon, m represents the valency of metal M, and n represents the number of 0.1 to 0.7, and has an initial amount of elution B being not more than 250, and an average hydrolysis rate constant A being at least 0.2 as defined by the following equation:

$$Y=AX+B$$

wherein X represents a duration in minutes from the time of preparing a sample solution by adding one gram of the inorganic phosphate compound to 100 ml of 4N sodium hydroxide solution up to 120 minutes, and Y represents an integrated amount of phosphate as $P_2O_5$ eluted into the sample solution in mg/100 ml.

14. A process according to claim 12, wherein the pellets, the alkali silicate solution and the single substance are mixed together before they are added to the container.

15. A process according to claim 12, wherein the alkali silicate solution contains 60% water.

16. A process according to claim 12, wherein the single substance is selected from the group consisting of gypsum, inorganic boron compound and inorganic phosphate compound.

17. A process according to claim 12, wherein the single substance is selected from the group consisting of semi-hydrated gypsum, anhydrous gypsum, calcium chloride, boron oxide, phosphorous pentoxide and zeolite.

18. A process according to claim 12, wherein the single substance acting as water absorbent absorbs water as bound water.

19. A process according to claim 12, wherein the alkali silicate solution is selected from the group consisting of sodium silicate solution and potassium silicate solution.

20. A process according to claim 12, wherein the alkali silicate solution comprises at least one of the following: metal oxide, metal hydroxide, metal silicate, and fluorosilicate.

21. A process according to claim 12, wherein the alkali silicate solution further includes a reinforcing agent.

22. A process according to claim 12, wherein the alkali silicate solution further includes a filler selected from the group consisting of kaolin, fired clay, acid clay, activated clay, titanium dioxide, zirconium dioxide, alumina powder, barium sulfate, magnesium carbonate, calcium carbonate, zinc oxide, anhydrous gypsum and sand.

23. A solidified radioactive waste product comprising:

a container;

radioactive waste pellets in said container; and solidified material produced by mixing a liquid alkali silicate solution and a hardening agent to react with and solidify the alkali silicate solution and produce water, and a water absorbent to absorb the produced water;

wherein the ratio of the amount of water absorbed to the total amount of water produced is in the range of 0.2 to 1 and further wherein said radioactive pellets are embedded in said solidified material.

24. The product according to claim 23 wherein the hardening agent is an inorganic phosphate composition.

25. The product according to claim 24 wherein the inorganic phosphate compound has a composition represented by the following formula:

$$MO_{n/2}.nP_2O_5$$

wherein M represents a metal including silicon, m represents the valency of metal M, and n represents the number of 0.1 to 0.7, and has an initial amount of elution B being not more than 250, and an average hydrolysis rate constant A being at least 0.2 as defined by the following equation:

$$Y=AX+B$$

wherein X represents a duration in minutes from the time of preparing a sample solution by adding one gram of the inorganic phosphate compound to 100 ml of 4N sodium hydroxide solution up to 120 minutes, and Y represents an integrated amount of phosphate as $P_2O_5$ eluted into the sample solution in mg/100 ml.

26. A product according to claim 23 wherein the pellets, the alkali silicate solution, the hardening agent and the water absorbent are mixed together before they are added to the container.

27. A product according to claim 23 wherein the alkali silicate solution contains 40–80% by weight of water.

28. A product according to claim 27, wherein the alkali silicate solution contains 60% water.

29. A product according to claim 23, wherein the water absorbent is capable of absorbing water as bound water.

30. A product according to claim 23, wherein the water absorbent is selected from the group consisting of cement, semi-hydrated gypsum and anhydrous gypsum.

31. A product according to claim 23, wherein the sodium silicate solution, the hardening agent and the water absorbent are added in a ratio of 1:0.4:0.2 respectively.

32. A product according to claim 23, wherein the alkali silicate solution comprises at least one of the following: metal oxide, metal hydroxide, metal silicate, and fluorosilicate.

33. A product according to claim 23, wherein the alkali silicate solution is selected from the group consisting of sodium silicate solution and potassium silicate solution.

34. A product according to claim 23, wherein the alkali silicate solution further includes reinforcing agent.

35. A product according to claim 23, wherein the alkali silicate solution further includes a filler selected from the group consisting of kaolin, fired clay, acid clay, activated clay, titanium dioxide, zirconium dioxide, alumina powder, barium sulfate, magnesium carbonate, calcium carbonate, zinc oxide, anhydrous gypsum and sand.

36. A product according to claim 23, wherein the hardening agent and the water absorbent are a single substance reacting with the alkali silicate solution to produce water and absorbing the produced water.

37. A product according to claim 36, wherein the single substance is selected from the group consisting of semi-hydrated gypsum, anhydrous gypsum, calcium chloride, boron oxide, phosphorous pentoxide and zeolite.

38. A product according to claim 36, wherein the single substance is selected from the group consisting of semi-hydrated gypsum, anhydrous gypsum, calcium chloride, boron oxide, phosphorous pentoxide and zeolite.

39. A solidified radioactive waste product prepared by the process comprising:

providing a container;

adding radioactive waste pellets to the container;

adding a liquid alkali silicate solution to the container;

adding a hardening agent to react with the alkali silicate solution to solidify the silicate and produce water; and adding a water absorbent to absorb the produced water;

wherein the ratio of the amount of water absorbed to the total amount of water produced is in the range of 0.2 to 1, to produce a container containing solid material having radioactive waste pellets embedded therein.

40. A product according to claim 39 wherein the hardening agent is an inorganic phosphate composition.

41. A product according to claim 39 wherein the inorganic phosphate compound has a composition represented by the following formula:

$MO_{n/2}.nP_2O_5$ wherein M represents a metal including silicon, m represents the valency of metal M, and n represents the number of 0.1 to 0.7, and has an initial amount of elution B being not more than 250, and an average hydrolysis rate constant A being at least 0.2 as defined by the following equation:

$$Y=AX+B$$

wherein X represents a duration in minutes from the time of preparing a sample solution by adding one gram of the inorganic phosphate compound to 100 ml of 4N sodium hydroxide solution up to 120 minutes, and Y represents an integrated amount of phosphate as $P_2O_5$ eluted into the sample solution in mg/100 ml.

42. A product according to claim 39 wherein the pellets, the alkali silicate solution, the hardening agent and the water absorbent are mixed together before they are added to the container.

43. A product according to claim 39 wherein the alkali silicate solution contains 40–80% by weight of water.

44. A product according to claim 43 wherein the alkali silicate solution contains 60% water.

45. A product according to claim 39, wherein the water absorbent is capable of absorbing water as bound water.

46. A product according to claim 39, wherein the water absorbent is selected from the group consisting of cement, semi-hydrated gypsum and anhydrous gypsum.

47. A product according to claim 39, wherein the sodium silicate solution, the hardening agent and the water absorbent are added in a ratio of 1:0.4:0.2 respectively.

48. A product according to claim 39, wherein the alkali silicate solution comprises at least one of the following: metal oxide, metal hydroxide, metal silicate, and fluorosilicate.

49. A product according to claim 39, wherein the alkali silicate solution is selected from the group consisting of sodium silicate solution and potassium silicate solution.

50. A product according to claim 39, wherein the alkali silicate solution further includes a reinforcing agent.

51. A product according to claim 39, wherein the alkali silicate solution further includes a filler selected from the group consisting of kaolin, fired clay, acid clay, activated clay, titanium dioxide, zirconium dioxide, alumina powder, barium sulfate, magnesium carbonate, calcium carbonate, zinc oxide, anhydrous gypsum and sand.

52. A product according to claim 39, wherein the hardening agent and the water absorbent are a single substance reacting with the alkali silicate solution to produce water and absorbing the produced water.

* * * * *